US010692710B2

(12) United States Patent
Prabhakaran et al.

(10) Patent No.: US 10,692,710 B2
(45) Date of Patent: Jun. 23, 2020

(54) FREQUENCY MODULATED RADIO FREQUENCY ELECTRIC FIELD FOR ION MANIPULATION

(71) Applicant: Battelle Memorial Institute, Richland, WA (US)

(72) Inventors: Aneesh Prabhakaran, Richland, WA (US); Yehia M. Ibrahim, Richland, WA (US); Sandilya V. B. Garimella, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 16/194,161

(22) Filed: Nov. 16, 2018

(65) Prior Publication Data

US 2019/0108990 A1 Apr. 11, 2019

Related U.S. Application Data

(63) Continuation-in-part of application No. 16/103,729, filed on Aug. 14, 2018, now Pat. No. 10,497,552.
(Continued)

(51) Int. Cl.
*H01J 49/06* (2006.01)
*H01J 49/02* (2006.01)

(52) U.S. Cl.
CPC ..... *H01J 49/022* (2013.01); *H01J 49/062* (2013.01); *H01J 49/063* (2013.01)

(58) Field of Classification Search
CPC ..... H01J 49/062; H01J 49/065; H01J 49/066; H01J 49/4235; H01J 49/022; H01J 49/424;
(Continued)

(56) References Cited

U.S. PATENT DOCUMENTS 3,202,995 A 8/1965 Schultz
3,617,908 A 11/1971 Greber
(Continued)

FOREIGN PATENT DOCUMENTS

AU 2014251354 B2 11/2017
AU 2016320584 A1 4/2018
(Continued)

OTHER PUBLICATIONS

English translation of the first Chinese office action from corresponding Chinese patent application No. 201710799275.X, dated Nov. 2, 2018, 12 pages.
(Continued)

*Primary Examiner* — David A Vanore
(74) *Attorney, Agent, or Firm* — Klarquist Sparkman, LLP

(57) ABSTRACT

A method of manipulating ions comprises injecting ions between a first surface and a second surface positioned parallel to and spaced apart from each other and defining a central axis therebetween, wherein the first surface comprises first outer electrodes coupled to the first surface and a first inner array of electrodes coupled to the first surface and positioned between the first outer electrodes, wherein the second surface comprises second outer electrodes coupled to the second surface and a second inner array of electrodes coupled to the second surface and positioned between the second outer electrodes, and applying a frequency modulated RF voltage to at least one electrode of the first inner array of electrodes or the second inner array of electrodes to confine ions between the first surface and the second surface and to guide ions between the first surface and the second surface along the central axis.

24 Claims, 10 Drawing Sheets

Related U.S. Application Data

(60) Provisional application No. 62/546,419, filed on Aug. 16, 2017.

(58) Field of Classification Search
CPC ..... H01J 2237/30472; H01J 49/0095; H01J 49/02; H01J 49/067; H01J 49/282; H01J 49/36; H01J 49/421; H01J 49/4245; H01J 49/4275; G01N 27/622; G01N 27/624
USPC .... 250/282, 288, 292, 396 R, 290, 293, 424
See application file for complete search history.

(56) References Cited

U.S. PATENT DOCUMENTS 4,777,363 A 10/1988 Eiceman et al.
5,206,506 A * 4/1993 Kirchner ..... G21K 1/003 250/281
5,572,035 A 11/1996 Franzen
5,818,055 A * 10/1998 Franzen ..... H01J 49/065 250/292
5,834,771 A 11/1998 Yoon et al.
6,107,628 A * 8/2000 Smith ..... H01J 49/066 250/292
6,322,703 B1 11/2001 Taniguchi et al.
6,417,511 B1 7/2002 Russ, IV
6,727,495 B2 4/2004 Li
6,744,043 B2 6/2004 Loboda
6,835,928 B2 12/2004 Bateman
6,891,157 B2 5/2005 Bateman et al.
6,960,760 B2 11/2005 Bateman et al.
7,071,467 B2 7/2006 Bateman
7,095,013 B2 8/2006 Bateman et al.
7,151,255 B2 12/2006 Weiss et al.
7,157,698 B2 1/2007 Makarov et al.
7,180,078 B2 2/2007 Pau et al.
7,365,317 B2 4/2008 Whitehouse et al.
7,391,021 B2 * 6/2008 Stoermer ..... H01J 49/065 250/281
7,405,401 B2 7/2008 Hoyes
7,548,818 B2 6/2009 Kieser
7,786,435 B2 8/2010 Whitehouse et al.
7,838,826 B1 11/2010 Park
7,872,228 B1 * 1/2011 Kim ..... H01J 49/423 250/287
7,888,635 B2 2/2011 Belov et al.
7,928,375 B1 4/2011 Mangan et al.
8,003,934 B2 8/2011 Hieke
8,049,169 B2 * 11/2011 Satake ..... H01J 49/4235 250/288
8,222,597 B2 7/2012 Kim et al.
8,299,443 B1 10/2012 Shvartsburg et al.
8,319,180 B2 11/2012 Nikolaev et al.
8,373,120 B2 2/2013 Verentchikov
8,389,933 B2 3/2013 Hoyes
8,410,429 B2 4/2013 Franzen et al.
8,581,181 B2 11/2013 Giles
8,658,969 B2 2/2014 Nishiguchi
8,698,075 B2 4/2014 Kurulugama et al.
8,716,660 B2 5/2014 Green et al.
8,809,769 B2 8/2014 Park
8,835,839 B1 * 9/2014 Anderson ..... H01J 49/06 250/290
8,841,608 B2 9/2014 Shvartsburg et al.
8,901,490 B1 12/2014 Chen et al.
8,907,272 B1 * 12/2014 Wouters ..... H01J 49/066 250/281
8,907,273 B1 12/2014 Chen et al.
8,969,800 B1 3/2015 Tolmachev et al.
9,063,086 B1 * 6/2015 Garimella ..... G01N 27/622
9,165,693 B2 10/2015 Urbanus et al.
9,536,721 B2 1/2017 Berdnikov et al.
9,704,701 B2 7/2017 Ibrahim et al.
9,812,311 B2 11/2017 Anderson et al.
9,939,409 B2 4/2018 Ibrahim et al.
9,966,244 B2 5/2018 Anderson et al.
10,139,366 B2 11/2018 Atamanchuk et al.
10,424,474 B2 * 9/2019 Ibrahim ..... H01J 49/40
2001/0035498 A1 * 11/2001 Li ..... H01J 49/062 250/398
2002/0074492 A1 6/2002 Taniguchi
2002/0185606 A1 * 12/2002 Smith ..... H01J 49/0404 250/423 R
2003/0132379 A1 * 7/2003 Li ..... G01N 27/622 250/286
2003/0222213 A1 12/2003 Taniguchi
2004/0026611 A1 2/2004 Bateman et al.
2004/0051038 A1 3/2004 Taniguchi
2004/0089803 A1 5/2004 Foley
2004/0195503 A1 * 10/2004 Kim ..... H01J 49/066 250/288
2004/0222369 A1 11/2004 Makarov et al.
2004/0251411 A1 12/2004 Bateman et al.
2005/0040327 A1 * 2/2005 Lee ..... H01J 49/4295 250/288
2005/0109930 A1 * 5/2005 Hill, Jr. ..... G01N 27/622 250/286
2005/0163183 A1 * 7/2005 Shackleton ..... H01S 3/038 372/55
2005/0258364 A1 11/2005 Whitehouse et al.
2006/0076484 A1 * 4/2006 Brown ..... H01J 49/062 250/290
2006/0219896 A1 10/2006 Hashimoto et al.
2007/0034810 A1 * 2/2007 Hoyes ..... H01J 49/427 250/396 R
2007/0138384 A1 6/2007 Keiser
2007/0162232 A1 * 7/2007 Patterson ..... H01J 49/022 702/1
2008/0073515 A1 3/2008 Schoen
2009/0173880 A1 * 7/2009 Bateman ..... H01J 49/065 250/292
2009/0206250 A1 * 8/2009 Wollnik ..... G01N 27/622 250/290
2009/0294655 A1 12/2009 Ding et al.
2009/0294662 A1 * 12/2009 Belov ..... H01J 49/066 250/291
2009/0302209 A1 * 12/2009 Green ..... H01J 49/065 250/282
2009/0321655 A1 * 12/2009 Makarov ..... H01J 49/065 250/396 R
2010/0032561 A1 * 2/2010 Giles ..... H01J 49/4235 250/283
2010/0038532 A1 * 2/2010 Makarov ..... H01J 49/062 250/288
2010/0294923 A1 * 11/2010 Kenny ..... H01J 49/0045 250/282
2011/0049357 A1 3/2011 Giles
2011/0127417 A1 * 6/2011 Ibrahim ..... H01J 49/004 250/282
2011/0192969 A1 8/2011 Verentchikov
2013/0009050 A1 * 1/2013 Park ..... H01J 49/063 250/281
2013/0099110 A1 * 4/2013 Hoyes ..... H01J 49/065 250/282
2013/0175441 A1 7/2013 Zanon et al.
2013/0313421 A1 11/2013 Taniguchi
2014/0061457 A1 3/2014 Berdnikov et al.
2014/0124663 A1 5/2014 Green et al.
2014/0145076 A1 5/2014 Park
2014/0217278 A1 8/2014 Green et al.
2014/0264014 A1 * 9/2014 Ibrahim ..... H01J 49/065 250/293
2014/0299766 A1 10/2014 Anderson et al.
2014/0361163 A1 12/2014 Taniguchi et al.
2014/0367564 A1 * 12/2014 Green ..... H01J 49/4265 250/282
2015/0028200 A1 1/2015 Green et al.
2015/0206731 A1 * 7/2015 Zhang ..... H01J 49/065 250/396 R
2015/0340220 A1 * 11/2015 Hock ..... H01J 49/4225 250/282

(56) References Cited

U.S. PATENT DOCUMENTS

| | | | | |
|---|---|---|---|---|
| 2015/0364309 | A1* | 12/2015 | Welkie | H01J 49/062 250/282 |
| 2015/0364313 | A1 | 12/2015 | Zhang et al. | |
| 2016/0027604 | A1 | 1/2016 | Cho et al. | |
| 2016/0047728 | A1 | 2/2016 | Wilson et al. | |
| 2016/0049287 | A1* | 2/2016 | Ding | H01J 49/004 250/283 |
| 2016/0071714 | A1 | 3/2016 | Zhang et al. | |
| 2016/0071715 | A1* | 3/2016 | Anderson | H01J 49/062 315/111.81 |
| 2016/0175856 | A1 | 6/2016 | Paschkewitz et al. | |
| 2016/0181080 | A1* | 6/2016 | Williams | H01J 49/063 250/292 |
| 2016/0189947 | A1 | 6/2016 | Zhou et al. | |
| 2016/0211129 | A1 | 7/2016 | Gardner | |
| 2017/0047212 | A1 | 2/2017 | Kenny | |
| 2017/0076931 | A1* | 3/2017 | Ibrahim | H01J 49/26 |
| 2017/0125229 | A1 | 5/2017 | Giles et al. | |
| 2017/0200596 | A1 | 7/2017 | Makarov et al. | |
| 2018/0061621 | A1 | 3/2018 | Anderson et al. | |
| 2018/0068839 | A1* | 3/2018 | Ibrahim | H01J 49/0095 |
| 2018/0254178 | A1 | 9/2018 | Ibrahim et al. | |
| 2018/0350582 | A1* | 12/2018 | Giles | H01J 49/24 |
| 2019/0004011 | A1* | 1/2019 | Garimella | H01J 49/0027 |
| 2019/0057852 | A1 | 2/2019 | Ibrahim et al. | |
| 2019/0066993 | A1 | 2/2019 | Ramsey et al. | |
| 2019/0103261 | A1* | 4/2019 | Ibrahim | H01J 49/061 |
| 2019/0108990 | A1* | 4/2019 | Prabhakaran | H01J 49/063 |
| 2019/0189393 | A1* | 6/2019 | Ibrahim | H01J 49/062 |
| 2019/0369050 | A1 | 12/2019 | Garimella et al. | |

FOREIGN PATENT DOCUMENTS

| | | | |
|---|---|---|---|
| AU | 2016335524 | A9 | 5/2018 |
| CA | 2908936 | | 10/2014 |
| CA | 2997910 | | 3/2017 |
| CA | 3000341 | | 4/2017 |
| CN | 1361922 | A | 7/2002 |
| CN | 101126738 | A | 2/2008 |
| CN | 102163531 | A | 8/2011 |
| CN | 102945786 | A | 2/2013 |
| CN | 201680069722 | | 8/2016 |
| CN | 105264637 | B | 9/2017 |
| CN | 107507751 | A | 12/2017 |
| CN | 108352288 | A | 7/2018 |
| DE | 112013004733 | | 6/2015 |
| EP | 1566828 | A2 | 8/2005 |
| EP | 1825495 | A2 | 8/2007 |
| EP | 2065917 | | 6/2009 |
| EP | 2913839 | | 9/2015 |
| EP | 2984675 | A1 | 2/2016 |
| EP | 3347913 | A1 | 7/2018 |
| EP | 3359960 | A1 | 8/2018 |
| GB | 2440970 | A | 2/2008 |
| GB | 2506362 | A | 4/2014 |
| JP | 2002-015699 | | 1/2002 |
| JP | 2003514349 | A | 4/2003 |
| JP | 2004-520685 | A | 7/2004 |
| JP | 2006294582 | A | 10/2006 |
| JP | 2009532822 | A | 9/2009 |
| JP | 2009535759 | A | 10/2009 |
| JP | 2009537070 | A | 10/2009 |
| JP | 2011529623 | A | 12/2011 |
| JP | 2012503286 | A | 2/2012 |
| JP | 2012528437 | A | 11/2012 |
| JP | 2014049196 | A | 3/2014 |
| JP | 2014509743 | A | 4/2014 |
| JP | 2014509772 | A | 4/2014 |
| JP | 2016514896 | A | 5/2016 |
| JP | 2018-518405 | | 8/2016 |
| JP | 2018528427 | A | 9/2018 |
| SG | 11201801852Q | | 5/2016 |
| SG | 11201802494Q | | 8/2016 |
| SG | 11201508277X | | 2/2018 |
| WO | WO 2001/35441 | | 5/2001 |
| WO | WO 2006/064274 | A2 | 6/2006 |
| WO | WO 2007/133469 | A2 | 11/2007 |
| WO | WO 2010/014077-Al | | 2/2010 |
| WO | WO 2010/032015-Al | | 3/2010 |
| WO | WO 2011/089419 | A2 | 7/2011 |
| WO | WO 2012/116765-Al | | 9/2012 |
| WO | WO 2012/123729 | | 9/2012 |
| WO | WO 2012/123730 | | 9/2012 |
| WO | WO 2013/018529 | A1 | 2/2013 |
| WO | WO 2014/048837 | A2 | 4/2014 |
| WO | WO 2014/168660 | A1 | 10/2014 |
| WO | WO 2015/056872 | | 4/2015 |
| WO | WO 2015/097462 | | 7/2015 |
| WO | WO 2016/069104-Al | | 5/2016 |
| WO | WO 2017/044159 | | 3/2017 |
| WO | WO 2017/062102 | | 4/2017 |

OTHER PUBLICATIONS

Office Action for European Application No. 14782685.3, dated Jan. 20, 2020.

Office Action for European Application No. 16724997.8, dated Jan. 8, 2020.

Office Action for U.S. Appl. No. 16/032,651, dated Jan. 10, 2020.

Office Action for U.S. Appl. No. 16/404,472, dated Apr. 14, 2020.

First Office Action mailed in Japanese Application No. 2018-216132, dated Aug. 21, 2019, 4 pages; with English translation, 4 pages.

First Office Action mailed in Japanese Application No. 2018-226767, dated Aug. 20, 2019, 2 pages; with English translation, 1 page.

Office Action corresponding to European Application No. 16754384.2, dated Sep. 11, 2019, 4 pages.

Chen, et al., "Mobility-Selected Ion Trapping and Enrichment Using Structures for Lossless Ion Manipulations", Analytical Chemistry, Jan. 2016, 88, pp. 1728-1733.

English translation of the first Chinese office action from corresponding Chinese patent application No. 201480032436.7, dated Oct. 14, 2016, 5 pages.

English translation of the search report from corresponding Chinese patent application No. 201480032436.7, dated Sep. 29, 2016, 2 pages.

Deng et al., "Serpentine Ultralong Path with Extended Routing (SUPER) High Resolution Traveling Wave Ion Mobility-MS using Structures for Lossles Ion Manipulations", Analytical Chemistry, Mar. 2017, 89, pp. 4628-4634.

European Search Report for European Patent Application No. 14782685.3, dated Oct. 25, 2016.

Examination Report No. 1 for related Australian Application No. 2016320584, dated Jun. 27, 2018, 3 pages.

Examination Report No. 2 for related Australian Application No. 2016320584, dated Sep. 3, 2018, 2 pages.

Examination Report No. 1 for related Australian Application No. 2016335524, dated May 15, 2018, 4 pages.

First Office Action for related Canadian Application No. 2,997,910, dated May 4, 2018, 4 pages.

First Office Action for related Canadian Application No. 3,000,341, dated Jul. 30, 2018, 5 pages.

First Office Action for Chinese Application No. 201680065673.2, dated Sep. 30, 2018, 14 pages.

First Office Action for related Japanese Application No. 2018-513012, dated Aug. 2, 2018, 2 pages; with English translation, 2 pages.

Hamid, Ahmed M. et al., "Characterization of Travelling Wave Ion Mobility Separations in Structures for Lossless Ion Manipulations," Analytical Chemistry, 87(22):11301-11308 (Nov. 2015).

International Search Report and Written Opinion for PCT/US2016/047070 (dated Nov. 7, 2016).

International Search Report and Written Opinion issued in related International Application No. PCT/US2016/030455, dated Jul. 25, 2016, 19 pages.

(56) References Cited

OTHER PUBLICATIONS

International Search Report and Written Opinion for related International Application No. PCT/US2014/011291, dated Jun. 6, 2014, 2 pages.
International Search Report and Written Opinion for related International Application No. PCT/US2018/041607, dated Sep. 20, 2018, 18 pp.
International Search Report and Written Opinion for related International Application No. PCT/US2018/046752, dated Dec. 4, 2018, 12 pp.
Search Report from corresponding Singapore patent application No. 11201508277X, dated Mar. 6, 2016, 7 pages.
Tolmachev, et al., "Characterization of Ion Dynamics in Structures for Lossless Ion Manipulations," Analytical Chemistry, 86(18):9162-9168 (Sep. 2014).
Webb et al., "Mobility-Resolved Ion Selection in Uniform Drift Field Ion Mobility Spectrometry/Mass Spectrometry: Dynamic Switching in Structures for Lossless Ion Manipulations," Analytical Chemistry, Oct. 2014, 86, 9632-9637.
Wojcik et al., "Lipid and Glycolipid Isomer Analyses Using Uitra-High Resolution Ion Mobility Spectrometry Separations", International Jouranl of Molecular Sciences, Jan. 2017, 18, 12 pp.
Written Opinion from the Intellectual Property Office of Singapore for related Application No. 11201802494Q, dated Aug. 21, 2018, 8 pages.
Written Opinion from the Intellectual Property Office of Singapore for related Application No. 11201801852Q, dated Nov. 22, 2018, 26 pages.

* cited by examiner

FREQUENCY MODULATED RADIO FREQUENCY ELECTRIC FIELD FOR ION MANIPULATION

CROSS REFERENCE TO RELATED APPLICATION

This application is a continuation-in-part of U.S. patent application Ser. No. 16/103,729, entitled "METHODS AND SYSTEMS FOR ION MANIPULATION," filed Aug. 14, 2018, which application claims the benefit of prior U.S. Provisional Application No. 62/546,419, entitled "METHODS AND DEVICE FOR ION CONFINEMENT AND MANIPULATION AT OR BELOW ATMOSPHERIC PRESSURE," filed Aug. 16, 2017. The full disclosures of U.S. patent application Ser. No. 16/103,729 and U.S., Provisional Application No. 62/546,419 are hereby incorporated by reference.

ACKNOWLEDGMENT OF GOVERNMENT SUPPORT

This disclosure was made with government support under Contract DE-AC05-76RL01830 awarded by the U.S. Department of Energy and Grant R33CA217699-01 awarded by the U.S. National Institute of Health. The government has certain rights in the invention.

FIELD

This disclosure relates to ion manipulation. More specifically, this invention relates to the use of frequency modulated radio frequency electric fields for ion manipulation at low pressures.

BACKGROUND

Confining and separating or otherwise manipulating ions with ion guides and/or ion traps is widely used in analytical techniques such as mass spectrometry (MS). Ion traps are also used for other applications such as quantum computing. Trapped ions can be used for accumulating a population of ions to be injected into an ion mobility drift cell to perform ion mobility spectrometry (IMS) to separate, identify, or distinguish ions or charged particles based on their size or collision cross section. IMS can be employed in a variety of applications such as separating structural isomers and resolving conformational features of charged chemical compounds, macromolecules, and essentially any charged particles. IMS may also be employed to augment mass spectroscopy in a broad range of applications, including metabolomics, glycomics, and proteomics, as well as for a broad range of applications involving essentially any compound that can be effectively ionized.

Radio Frequency (RF) fields are commonly utilized in ion traps and ion guides for ion confinement. RF voltages are typically applied 180° out of phase to effectively generate a pseudopotential that confines ions and prevents ions from approaching electrodes generating the RF fields. The axial motion of ions inside an ion guide can be produced by a DC gradient, a traveling wave, or a gas flow.

SUMMARY

The foregoing and other objects, features, and advantages of the invention will become more apparent from the following detailed description, which proceeds with reference to the accompanying figures.

In one representative embodiment, a method of manipulating ions can comprise injecting ions between a first surface and a second surface positioned parallel to and spaced apart from each other and defining a central axis therebetween, wherein the first surface comprises first outer electrodes coupled to the first surface and a first inner array of electrodes coupled to the first surface and positioned between the first outer electrodes, and wherein the second surface comprises second outer electrodes coupled to the second surface and a second inner array of electrodes coupled to the second surface and positioned between the second outer electrodes, and applying a frequency modulated RF voltage to at least one electrode of the first inner array of electrodes or the second inner array of electrodes to confine ions between the first surface and the second surface and to guide ions between the first surface and the second surface along the central axis.

In any of the disclosed embodiments, the frequency modulated RF voltage applied to the at least one electrode of first the inner array of electrodes or the second inner array of electrodes can be phase shifted with a frequency modulated voltage applied to an adjacent electrode.

In any of the disclosed embodiments, the first outer electrodes can extend substantially along the length of the first surface and the second outer electrodes can extend substantially along the length of the second surface.

In any of the disclosed embodiments, the first inner array of electrodes can extend substantially along the length of the first surface and the second inner array of electrodes can extend substantially along the length of the second surface.

In any of the disclosed embodiments, the frequency modulated RF voltage can comprise a carrier signal and a modulating signal.

In any of the disclosed embodiments, the method can further comprise applying a DC voltage to the first outer electrodes and the second outer electrodes.

In any of the disclosed embodiments, the method can further comprise applying an RF voltage to the first outer electrodes and the second outer electrodes.

In any of the disclosed embodiments, the frequency modulated RF voltage can comprise a carrier signal and a modulating signal and the RF voltage applied to the outer electrodes can comprise the carrier signal.

In another representative embodiment, a method of manipulating ions can comprise injecting ions within an interior of an apparatus comprising a plurality of ring electrodes arranged longitudinally adjacent to each other and defining a central axis therethrough, and applying a frequency modulated RF voltage to at least one ring electrode to confine ions within the apparatus and to guide ions through the apparatus.

In any of the disclosed embodiments, the frequency modulated RF voltage applied to the at least one ring electrode can be phase shifted with a frequency modulated RF voltage applied to an adjacent ring electrode.

In any of the disclosed embodiments, the frequency modulated RF voltage can comprise one of: a sine wave, a triangular wave, a square wave, or a rectangular wave.

In another representative embodiment, an ion manipulation device can comprise a first surface and a second surface positioned parallel to and spaced apart from each other and defining a central axis therebetween, first outer electrodes coupled to the first surface and second outer electrodes coupled to the second surface, a first inner array of electrodes coupled to the first surface and a second inner array of electrodes coupled to the second surface, and a voltage source to apply a frequency modulated RF voltage to at least one electrode of the first inner array of electrodes or the second inner array of electrodes to confine ions between the first surface and the second surface and to guide ions between the first surface and the second surface along the central axis without a DC voltage being applied to the at least one electrode.

In any of the disclosed embodiments, the frequency modulated RF voltage applied to the at least one electrode can be phase shifted with a frequency modulated RF voltage applied to an adjacent electrode.

In any of the disclosed embodiments, the first inner array of electrodes can be positioned between the first outer electrodes, and the second inner array of electrodes can be positioned between the second outer electrodes.

In any of the disclosed embodiments, the first outer electrodes can extend substantially along the length of the first surface and the second outer electrodes can extend substantially along the length of the second surface.

In any of the disclosed embodiments, the first inner array of electrodes can extend substantially along the length of the first surface and the second inner array of electrodes can extend substantially along the length of the second surface.

In any of the disclosed embodiments, the frequency modulated RF voltage can comprise a carrier signal and a modulating signal.

In any of the disclosed embodiments, at least one of the first outer electrodes and the second outer electrodes can be configured to receive a DC voltage.

In any of the disclosed embodiments, at least one of the first outer electrodes and the second outer electrodes can be configured to receive an RF voltage.

In any of the disclosed embodiments, at least one of the first outer electrodes or the second outer electrodes can be configured to receive an RF voltage comprising the carrier signal.

In any of the disclosed embodiments, the first surface and the second surface can comprise at least one angled portion.

In another representative embodiment, an ion manipulation device can comprise a plurality of ring electrodes arranged longitudinally adjacent to each other and defining a central axis therethrough, and a voltage source to apply a frequency modulated RF voltage to at least one ring electrode to confine ions within an interior of the device and to guide ions through the device along the central axis without a DC voltage being applied to the at least one ring electrode.

In any of the disclosed embodiments, the frequency modulated RF voltage applied to the at least one ring electrode can be phase shifted with a frequency modulated RF voltage applied to an adjacent ring electrode.

In any of the disclosed embodiments, a diameter of at least one ring electrode can be different than a diameter of an adjacent electrode.

DETAILED DESCRIPTION

Figures 1A, 1B, 1C:
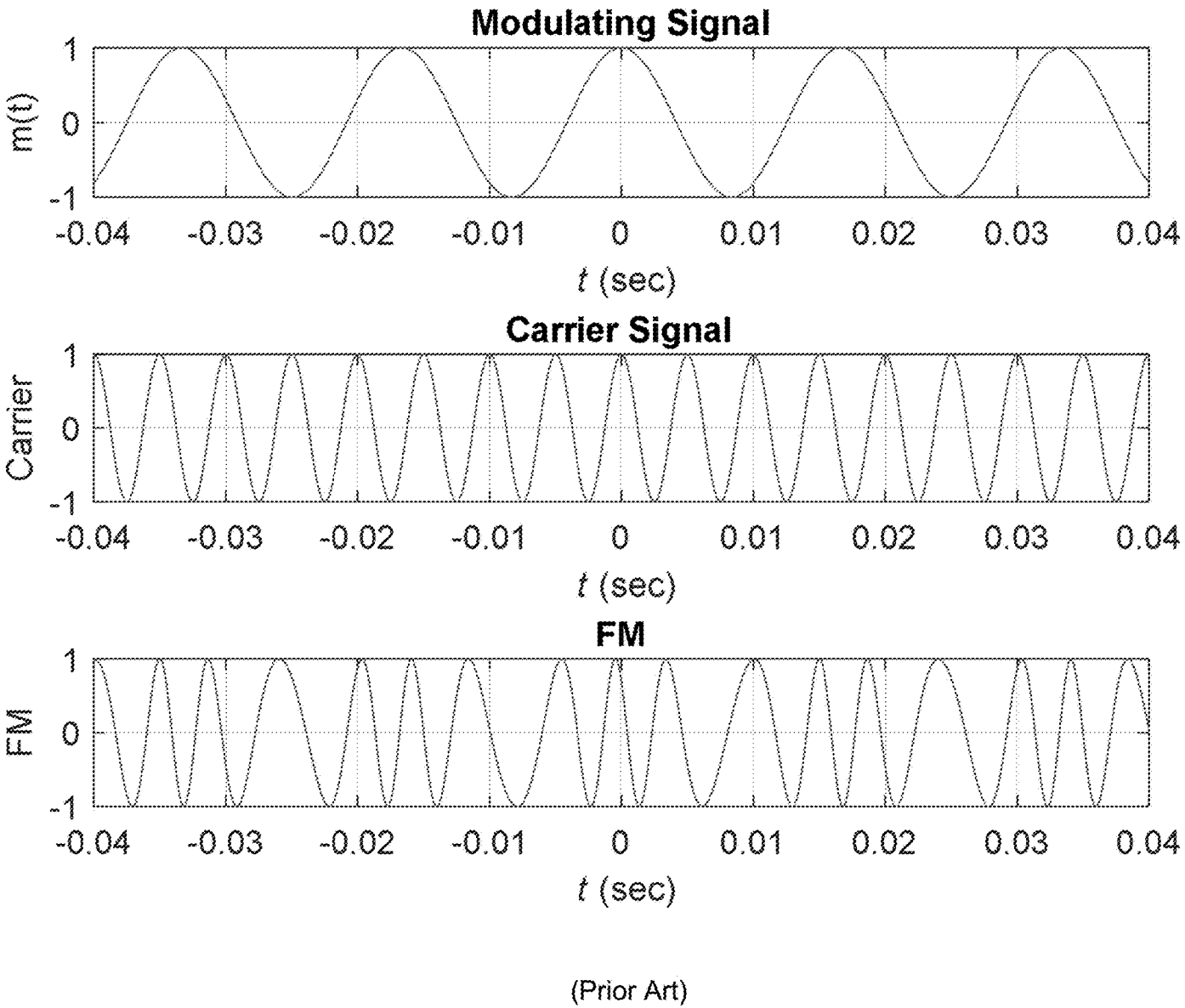
FIG. 1C (Prior Art)
FIGS. 1A-1C show plots of exemplary AC signals that can be used with the present disclosure.

Certain exemplary embodiments will now be described to provide an overall understanding of the principles of the structure, function, manufacture, and use of the systems, devices, and methods disclosed herein.

The disclosure of numerical ranges should be understood as referring to each discrete point within the range, inclusive of endpoints, unless otherwise noted. Unless otherwise indicated, all numbers expressing quantities of components, dimensions, properties, percentages, and so forth, as used in the specification or claims are to be understood as being modified by the term "about." Accordingly, unless otherwise implicitly or explicitly indicated, or unless the context if properly understood by a person of ordinary skill in the art to have a more definitive construction, non-numerical properties or characteristics or the like, such as traveling waves and so forth, as used in the specification or claims are to be understood as being modified by the term "substantially," meaning to a great extent or degree as would be understood by those skilled in the technical field. In some instances as used herein, when modifying a length or distance, the term "substantial" or "substantially" means within 1% of the length or distance.

In at least some instances, approximating language may correspond to the precision of an instrument for measuring the value. Here and throughout the specification and claims, range limitations may be combined and/or interchanged, such ranges are identified and include all the sub-ranges contained therein unless context or language indicates otherwise. Accordingly, unless otherwise indicated, implicitly or explicitly, the numerical parameters and/or non-numerical properties or characteristics or the like, set forth are approximations that may depend on the desired properties sought, limits of detection under standard test conditions/methods, limitations of the processing method, the understood meanings of the terms in the technical field, and/or the nature of the parameter or property. When directly and explicitly distinguishing embodiments from discussed prior art, the embodiment numbers are not approximates unless the word "about" is recited.

Although there are alternatives for various components, parameters, operating conditions, etc. set forth herein, that does not mean that those alternatives are necessarily equivalent and/or perform equally well. Nor does it mean that the alternatives are listed in a preferred order unless stated otherwise.

When performing IMS in a conventional drift tube, a sample composed of ions having different mobilities can be injected into a first end of an enclosed cell containing a carrier gas, also referred to as a buffer gas. In the cell, the ions can move from the first end of the cell to a second end of the cell under the influence of one or more applied electric fields. The ions can be subsequently detected at the second end of the cell as a function of time. The sample ions can achieve a maximum, constant velocity (i.e., a terminal velocity) arising from the net effects of acceleration due to the applied electric fields and deceleration due to collisions with the buffer gas molecules. The terminal velocity of the ions increases with the magnitude of the electric field and is proportional to their respective mobilities, which are related to ion characteristics such as mass, size, shape, and charge. Ions that differ in one or more of these characteristics will exhibit different mobilities when moving through a given buffer gas under a given electric field and, therefore, will achieve different terminal velocities. As a result, each ion exhibits a characteristic time for travel from the first end of the cell to the second end of the cell. By measuring this characteristic travel time for ions within a sample, the ions can be distinguished or identified.

There are a number of IMS formats used for chemical and biochemical analysis, including constant field drift tube ion mobility spectrometry (DT-IMS), high field asymmetric ion mobility spectrometry (FA-IMS), differential mobility analysis (DMA), trapped ion mobility spectrometry (TIMS), and traveling wave ion mobility spectrometry (TW-IMS). These formats vary in the manner by which the electric field is applied to separate the ions within the IMS cell or device.

Ion traps, on the other hand, manipulate ions based on their mass to charge ratio. Ions react to electric field oscillation in radio frequency (RF) by executing a simple harmonic motion between electrodes on which the RF fields are applied. In this way, they remain in dynamic equilibrium and can be effectively trapped, manipulated, and interacted with by other ions, neutrals, photons, etc.

In either ion traps or ion guides, devices generally involve both guiding ions through the device and confining ions within the device as the ions move through the device to prevent the ions from colliding with the surfaces of the device itself and causing loss of ions. This typically involves the application of RF electric fields to confine ions radially within the device and a DC gradient field to move ions axially through the device. Generating both RF electric fields and a DC gradient field increases the cost and complexity of the devices. Thus, such devices can be improved by lowering their cost and/or complexity if a single voltage source generating RF fields can be utilized to both confine ions and move ions through the device without the necessity of applying a separate DC field.

The present disclosure is directed to devices, apparatuses, and methods of effectively confining, separating or otherwise manipulating ions. Unlike known ion manipulation devices that use RF fields to confine ions radially within the device and separate DC fields to move ions axially through the device, the present disclosure uses frequency modulated RF fields to both confine ions and move ions axially such that they can be separated according to their mobility in a background gas. There is no need for an additional DC gradient or traveling wave to move the ions forward in order to create ion separation. This can simplify such devices compared to existing ion manipulation devices and can also allow for the miniaturization of the devices. This can decrease the cost and complexity of such devices because a single voltage source can be used to generate the required electric fields.

To confine an ion in a region of space, the ion should be restored back to its original position by a force which is defined by Hooke's law as:

$$\vec{F}=-c\vec{r} \tag{1}$$

where c is the spring constant and $\vec{r}$ is the displacement of the particle from the equilibrium position. The electrostatic force experienced by an ion in a potential U can be expressed in terms of a scalar as:

$$\vec{F}=-\nabla U \tag{2}$$

Combining equations (1) and (2) above, yields $$U=\frac{c}{2}(\alpha x^2+\beta y^2+\gamma z^2)+Const \tag{3}$$

where α, β, and γ are constants in three spatial directions which determine the shape of the potential and Const is a floating voltage or applied bias voltage. Considering that the space charge is negligible and applying the Laplace equation, $\nabla^2=0$ yields $$\alpha+\beta+\gamma=0 \tag{4}$$

Equation (4) above can be satisfied in a variety of ways. In one example, α=−β=1, and γ=0. This corresponds to a Quadrupole Mass Filter or Linear Ion Trap. In another example, α=β=1, and γ=−2. This corresponds to a Quadrupole Ion Trap. The desired potential in equation (3), assuming the float potential to be zero, will be of the form:

$$U=\frac{\phi}{2r_0^2}(\alpha x^2+\beta y^2+\gamma z^2) \tag{5}$$

where ϕ is a static potential.

The potential of the form in equation (5) generates a saddle-point potential. In this type of potential, an ion is confined in one direction but can escape in a perpendicular direction. However, if the confining potential in the perpendicular direction is reversed before it has the ion has time to escape, the reversed potential drives the ion back towards the trap center. Therefore, the particle will remain confined as long as an appropriate frequency is chosen. This can be done by replacing the static potential ϕ in equation (5) with a time-dependent potential (e.g., an RF potential).

$$U=\frac{\phi(t)}{2r_0^2}(\alpha x^2+\beta y^2+\gamma z^2) \tag{6}$$

where $\phi(t)=V_0\cos(\omega t)+V_{DC}$ $V_0$ is the RF amplitude, w is the angular frequency and $V_{DC}$ is the DC bias voltage.

In general, adjacent confining electrodes can receive RF voltages that are applied with 180° out of phase so that there are two out-of-phase saddle surfaces at a time.

$$\phi_1(t)=V_0\cos(\omega t)+V_{DC} \tag{7}$$

$$\phi_2(t)=-V_0\cos(\omega t)+V_{DC} \tag{8}$$

Though it should be noted that it is not necessary that the voltages be 180° out of phase. Any phase difference will be enough if a suitable frequency is chosen. In the present disclosure, more sophisticated RF signals are applied as discussed below.

Frequency modulation is generally used in communication to transmit a signal over a long distance. Typically, the signal (having a relatively low frequency) is frequency modulated with a carrier frequency (having a relatively high frequency) and transmitted. Then at the receiver, the frequency modulated signal is demodulated to separate the signal from the carrier.

FIGS. 1A-1C show the general principle of frequency modulation. FIG. 1A shows an exemplary modulating signal (e.g., the message to be transmitted). FIG. 1B shows an exemplary carrier signal. The modulating signal can be represented as $V_m \sin(2\pi f_m t)$ and the carrier signal can be represented as $V_c \cos(2\pi f_c t)$. Then, the modulated signal, as shown in FIG. 1C will be represented as:

$$S_{FM}=V_c \cos(2\pi f_c t+\beta 2\pi f_m t) \tag{9}$$

where $S_{FM}$ is the resultant frequency modulated wave, β is the modulation index represented as:

$$\beta = \frac{k_f v_m}{f_m} \tag{10}$$

where $V_c$ is the carrier amplitude, $V_m$ is the modulating signal amplitude, $k_f$ is the frequency deviation constant, $f_c$ is the carrier frequency, and $f_m$ is the modulating signal frequency.

In Linear Ion Traps, where out-of-phase RF voltages are applied to confining electrodes as described above by equations (8) and (9) to create an inhomogeneous electric field, ions experience an effective potential or pseudopotential given by:

$$V_{pseudo} = \frac{q}{4m\omega^2}E^2 \tag{11}$$

where q is the charge of the ion, m is its mass, E is the amplitude of the applied RF voltages and ω is their angular frequency.

Figure 2A:
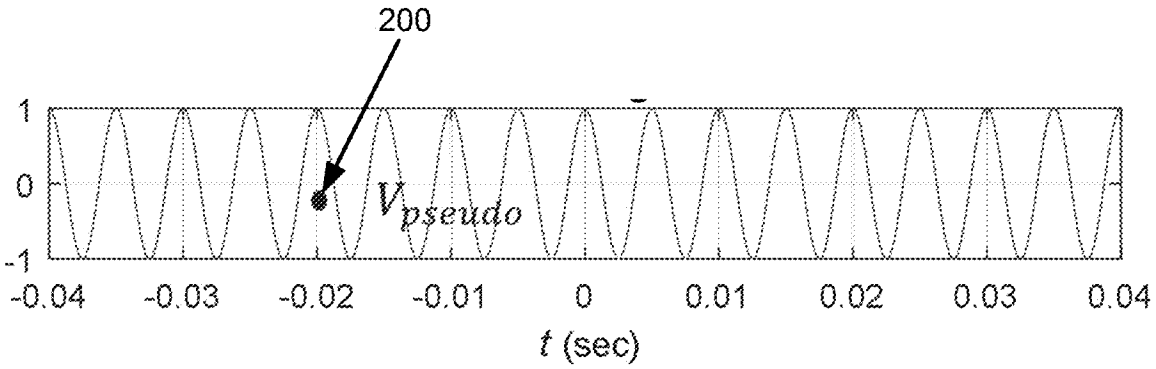
FIG. 2A shows a plot of the effective potential experienced by an ion in a radio frequency electric field.
Figure 2B:
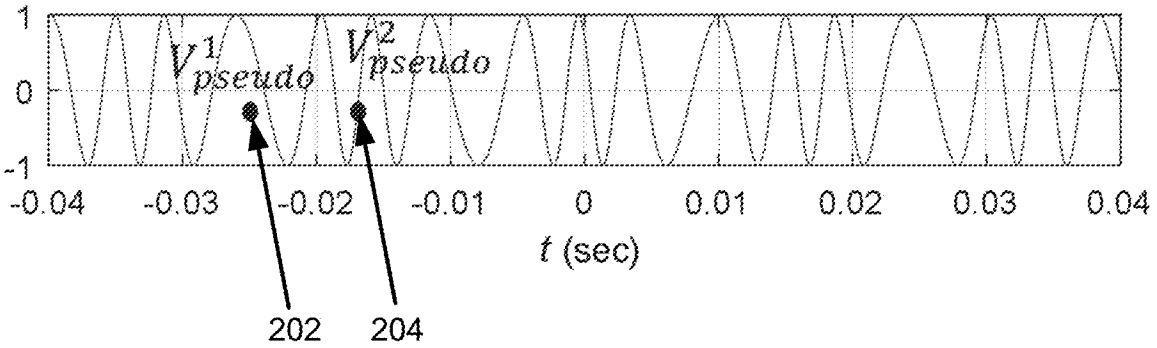
FIG. 2B shows a plot of the effective potential experienced by an ion in a frequency modulated radio frequency electric field.

FIG. 2A shows an ion in a constant frequency RF electric field. In the electric field of FIG. 2A, an ion 200 experiences the same pseudopotential Vpseudo at all times since the RF field has a constant frequency. FIG. 2B shows a frequency modulated RF field. In the electric field of FIG. 2B, an ion 202 experiences pseudopotential $V_{pseudo}^1$ at a first point in time and an ion 204 experiences a pseudopotential $V_{pseudo}^2$ at a later point in time. Because the frequency modulated RF field changes its frequency over time, $V_{pseudo}^1$ and $V_{pseudo}^2$ are different. As such, the inventors discovered that a frequency modulated RF voltage can be applied to electrodes of an ion manipulation device to effectively create a traveling pseudopotential that moves through the device, as disclosed in further detail below. This traveling pseudopotential both confines ions within the device in one spatial direction and moves ions through the device in another spatial direction. The inventors discovered that this can be accomplished by applying a phase shifted frequency modulated signal to a series of electrodes, as explained in further detail below.

Figure 3:
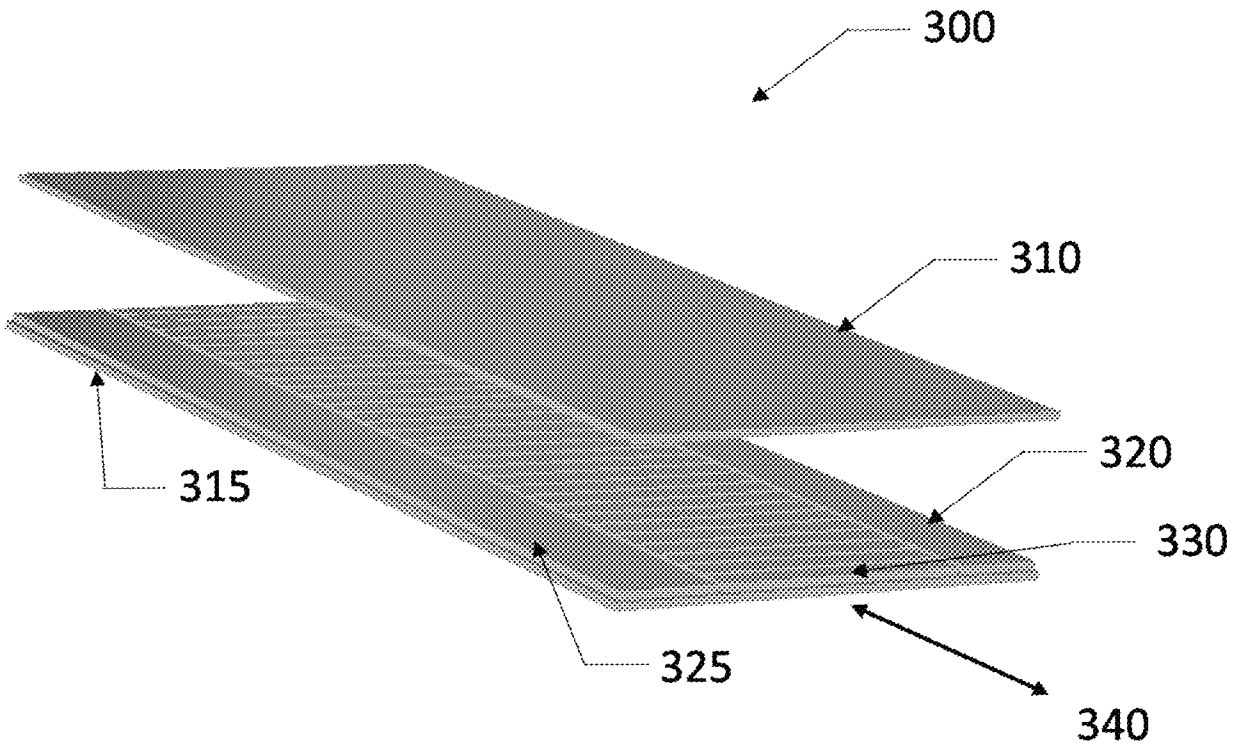
FIG. 3 shows an embodiment of an exemplary ion manipulation device.

FIG. 3 shows an exemplary ion manipulation device 300. The device 300 comprises two parallel surfaces 310 and 315 spaced apart from each other. The surfaces 310, 315 define a central axis 340 through the device 300. Each of the surfaces 310, 315 contains an array of inner electrodes 330 and outer guard electrodes 320, 325. The outer electrodes 320, 325 are positioned on either side of the array of inner electrodes 330. The array of inner electrodes 330 and the outer electrodes 320, 325 extend substantially along the length of the surfaces 310, 315. In the illustrated example, the arrangement of electrodes can be identical on the two surfaces 310, 315. In operation, ions can be confined between the surfaces 310, 315 and guided along the central axis 340. In some examples, the device 300 can contain angled portions such that ions can be guided through the device in other ways than in a straight line. In the illustrated example, the device can operate at pressures from 0.001 Torr to 100 Torr.

Figure 4:
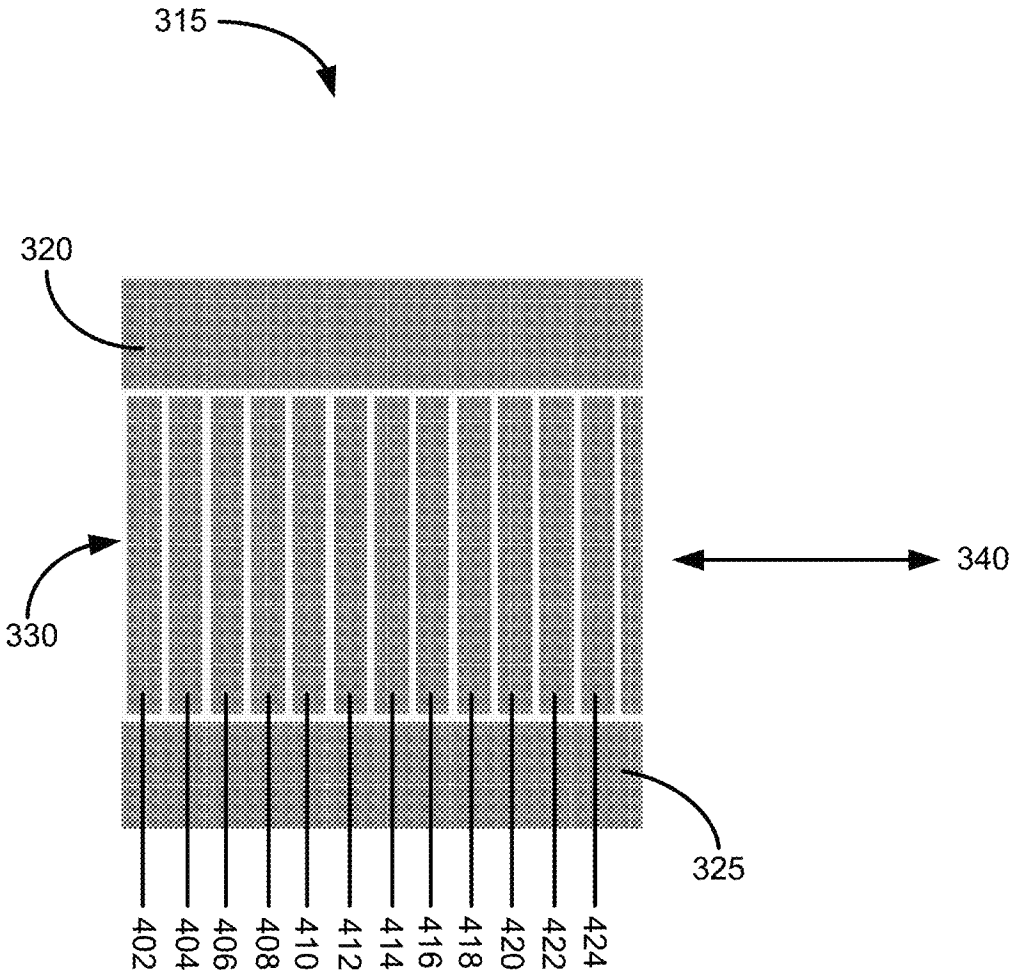
FIG. 4 shows an embodiment of a surface of an exemplary ion manipulation device.
Figures 5A, 5B, 5C, 5D:
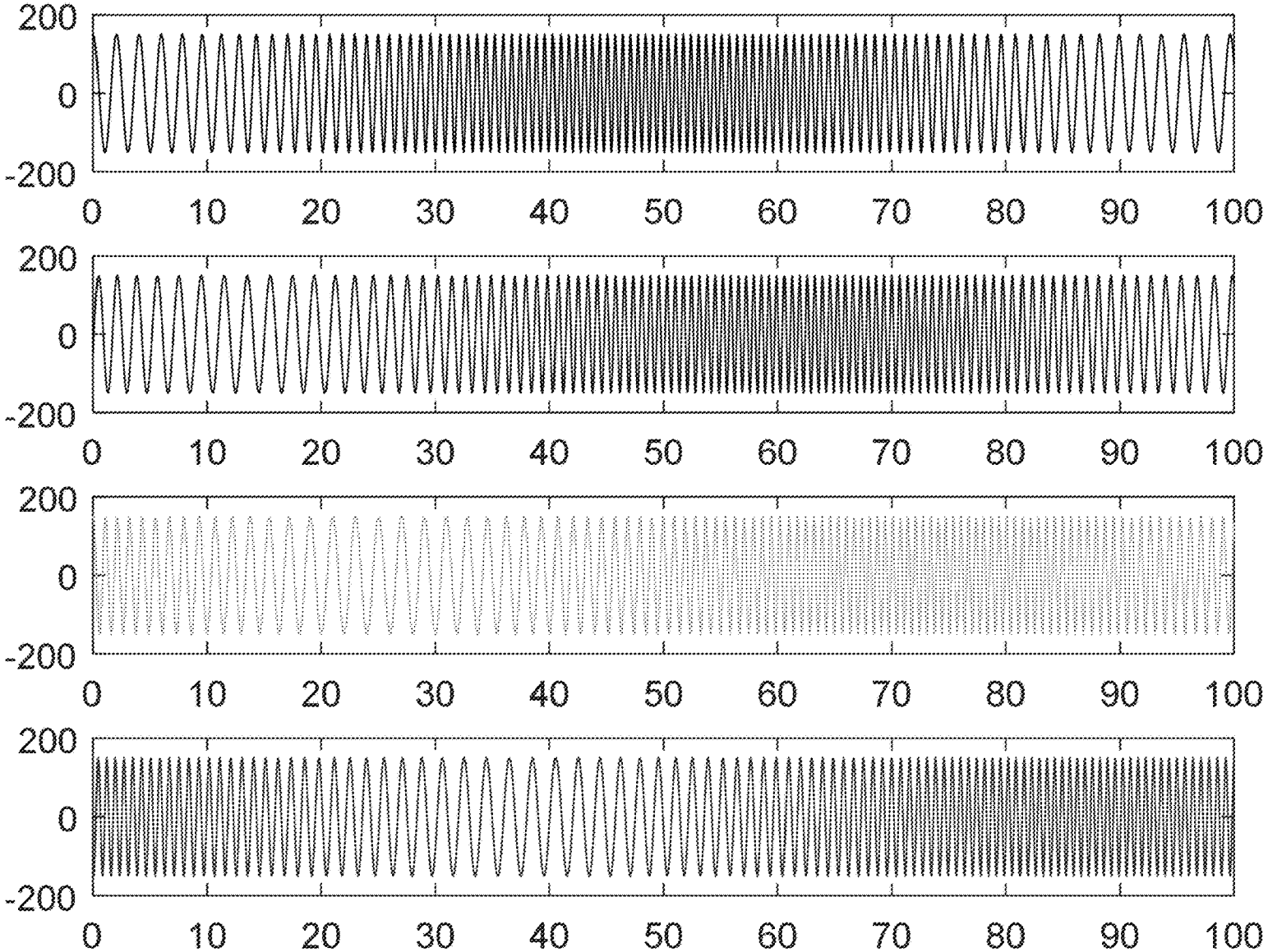
FIGS. 5A-5D show plots of frequency modulated RF voltages that can be used with the present disclosure.

FIG. 4 shows a portion of the surface 315 of the ion manipulation device 300. In the illustrated example of FIG. 4, the outer arrays of electrodes 320, 325 each comprise a single elongated electrode. The inner array of electrodes 330 comprises a series of electrodes 402, 404, 406, etc. In the illustrated example, the surface 325 of the device 300 comprises electrodes in a similar arrangement as shown in surface 315 of FIG. 4. In the illustrated example of FIG. 4, twelve electrodes are shown on the surface 315. However, the surface 315 can comprise any number of electrodes. In the illustrated example, the number of electrodes that are part of the array 330 are equal to the number of electrodes needed to extend across the entire length of the surface 315. A voltage source (not shown) can apply a voltage to each electrode 302-324 individually.

As shown in equation (9), a frequency modulated signal can be represented as:

$$S_{FM}=V_c \cos(2\pi f_c t+\beta 2\pi f_m t) \tag{12}$$

To move this signal forward through the ion manipulation device 300, an axial traveling wave is applied as the modulating signal MS, as:

$$MS=\sin(2\pi(x-vt)/\lambda) \tag{13}$$

where x is equal to the width of the electrodes 402-424 plus the spacing between the electrodes, v is the wave speed, and λ is the wavelength of the frequency modulation cycle, as explained below. Thus, the frequency modulated signal of the illustrated example can be represented as:

$$S_{FM}=V_c \cos(2\pi f_c t+\beta * MS) \tag{14}$$

This thereby results in a traveling pseudopotential, wherein the voltage applied to each of the electrodes 330 creates a pseudopotential that moves along the surfaces 310, 315 to confine ions between the surfaces, and whereby the traveling nature of the pseudopotential causes ions to move axially through the device 300.

In the illustrated example of FIG. 4, each adjacent electrode 402-424 receives a frequency modulated RF voltage as described above in equation (14) to create the traveling pseudopotential. FIGS. 5A-5D show the voltage applied to electrodes 402, 404, 406, and 408 respectively of the surface 315 over time. As can be seen in FIGS. 5A-5D, the voltage applied to these electrodes is a frequency modulated AC signal and the phase of the signal is shifted across each adjacent electrode. In the illustrated example, the modulating signal MS described in equation (13) is phase shifted by 45 degrees between each pair of adjacent electrodes, such that every eight electrodes comprises one complete phase shifted cycle and the modulating signal applied to the ninth such electrode (e.g., electrode 418) is in phase with the modulating signal MS applied to the first electrode (e.g., electrode 402) and the modulating signal applied to the tenth electrode (e.g., electrode 420) is in phase with the modulating signal applied to the second electrode (e.g., electrode 404), etc. Thus, in the illustrated example, the value of λ in equation (13) is the distance between electrode 402 and electrode 416 (e.g., the span of eight electrodes). In other examples, the amount that each AC signal is phase shifted between adjacent electrodes can be a different amount and the value of A in equation (14) is the distance comprising the span between the first and last electrode of a complete cycle.

Figure 10:
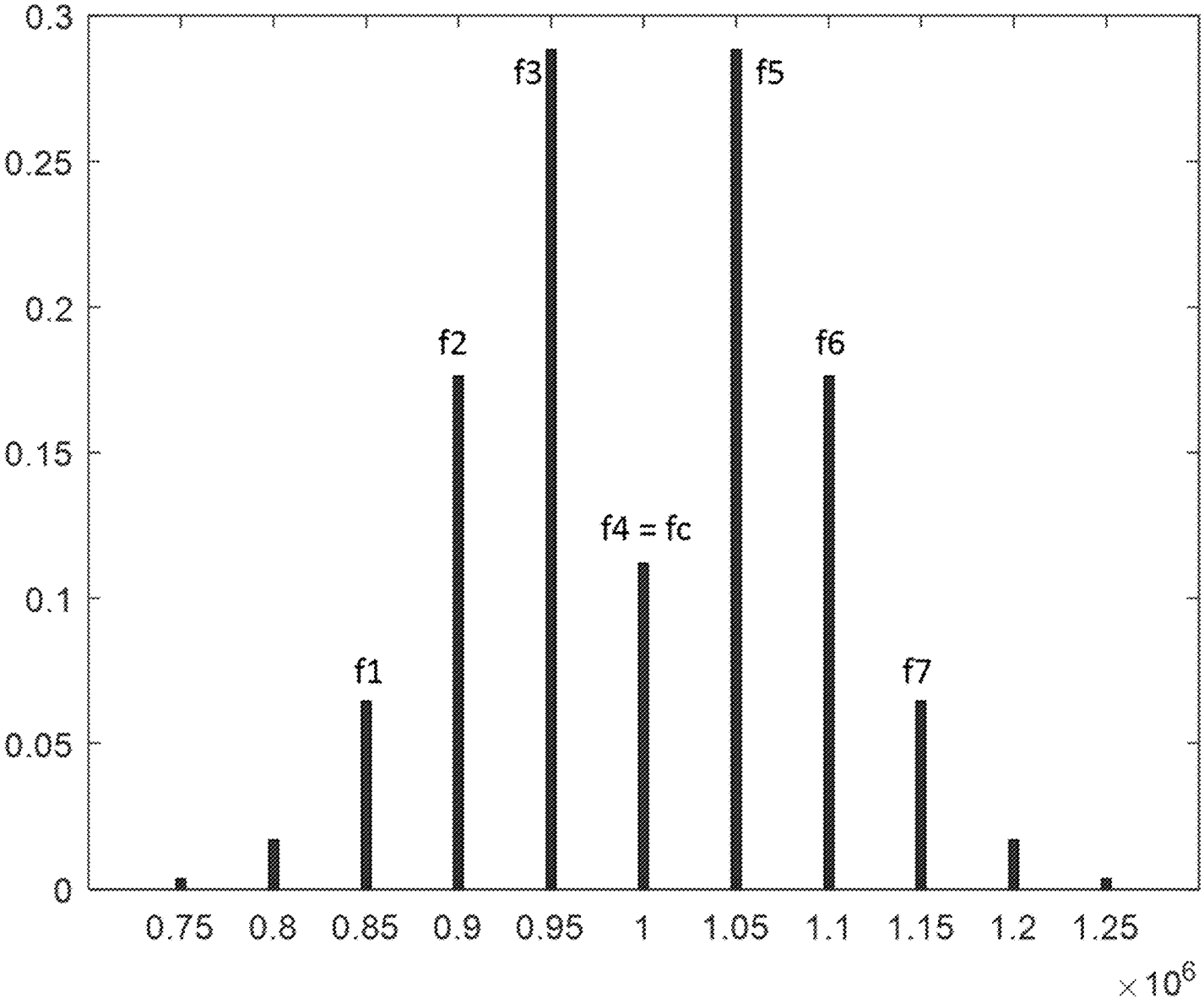
FIG. 10 shows an example sideband spectra of a frequency modulated signal.

In some examples, the frequency modulated voltage can be replaced with a range of frequencies around a carrier frequency chosen from the sideband spectra, as shown in FIG. 10, and applied successively to adjacent electrodes. For example, at a given time t1, adjacent electrodes can receive, in order, RF voltages with frequencies f1, f2, f3, f4, f5, f6, f7, f6, f5, f4, f3, f2, f1. At a later time t2, the applied voltages can be stepped forward such that adjacent electrodes can receive, in order, RF voltages with frequencies f2, f3, f4, f5, f6, f7, f6, f5, f4, f3, f2, f1, f2. This pattern can continue for additional time periods.

In the illustrated example, the modulating signal MS comprises a sinusoidal waveform. In other examples, the modulating signal MS can comprise a waveform of any arbitrary shape (e.g., a triangle wave, square wave, rectangular wave, etc.). By applying a phase shifted frequency modulated signal to adjacent electrodes on the surface 315 of the ion manipulation device 300, ions are both confined within the device and moved through the device, as explained above.

Figure 6A:
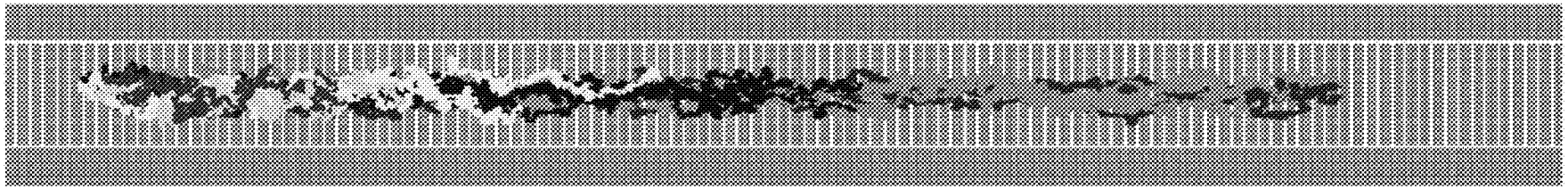
FIG. 6A-6C show simulation results of ion confinement within exemplary ion manipulation devices.
Figure 6B:
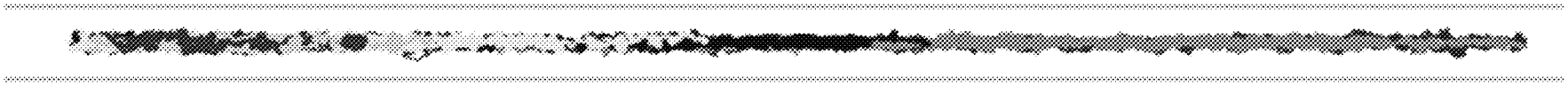
Figure 6C:
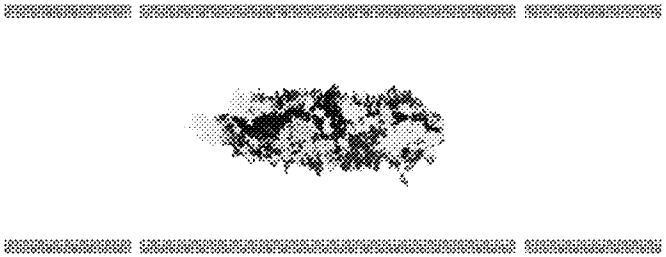
Figure 7A:
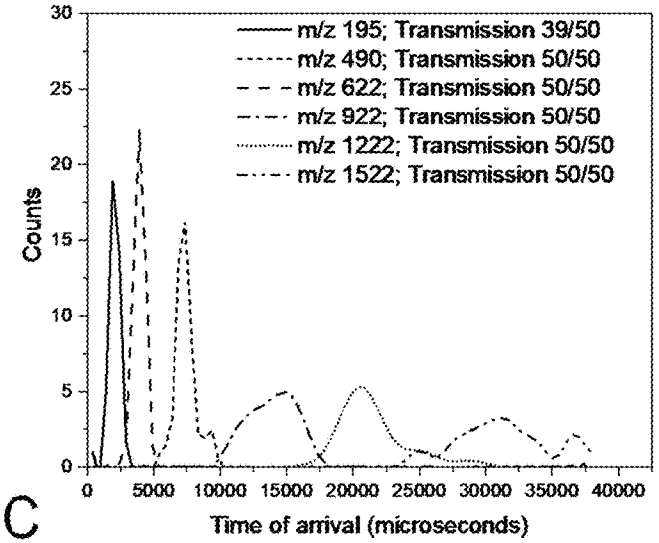
FIGS. 7A-7D show plots of arrival time distribution of ions from simulation results of ion confinement within exemplary ion manipulation devices.
Figure 7B:
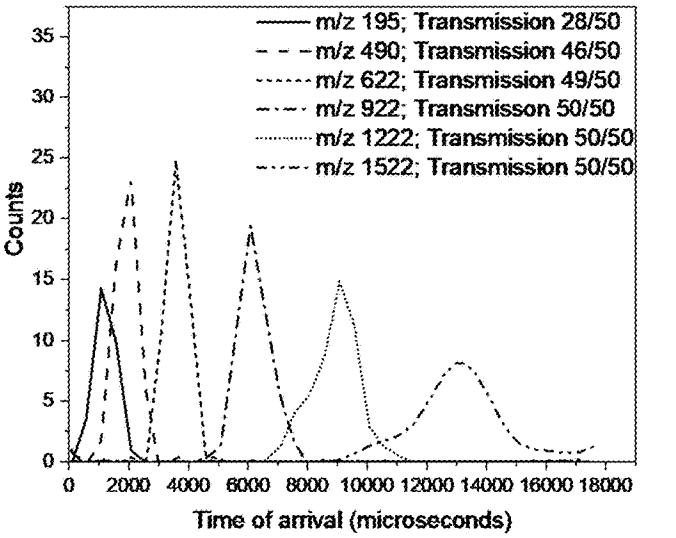
Figure 7D:
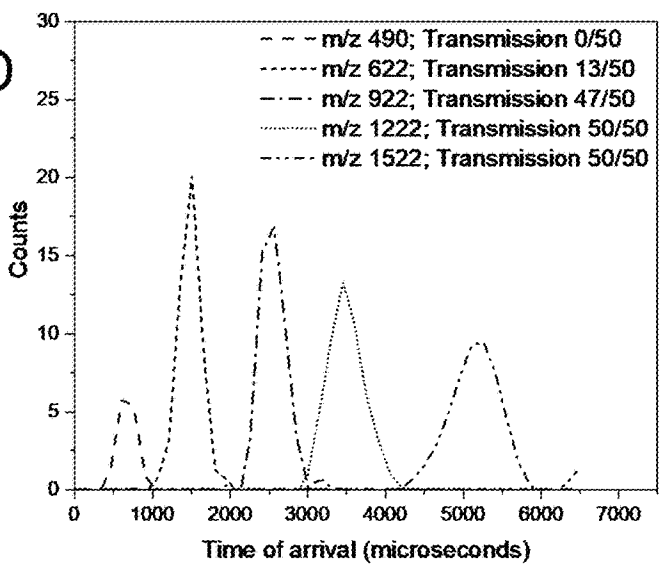
Figure 7C:
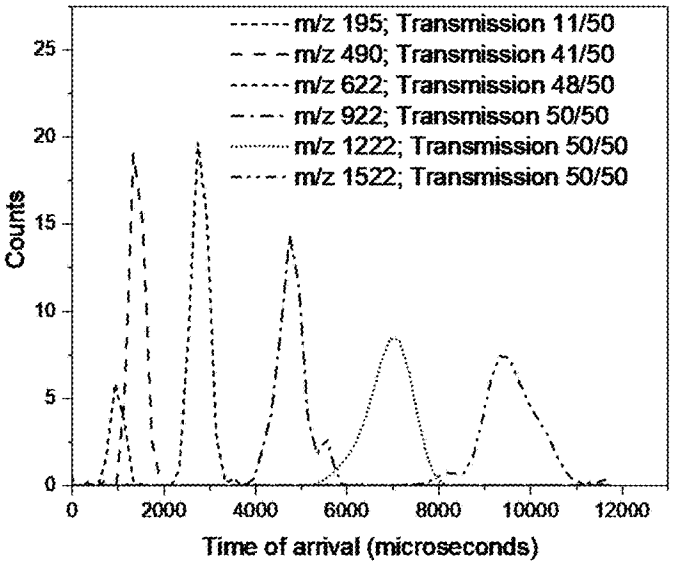
Figure 8A:
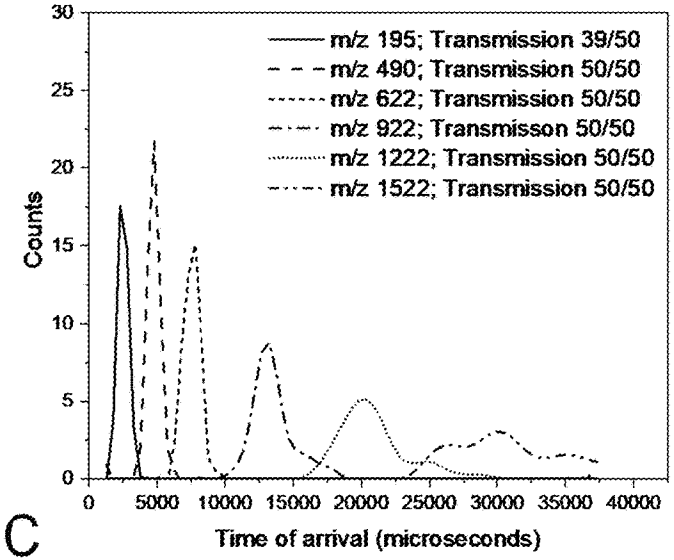
FIGS. 8A-8D show plots of arrival time distribution of ions from additional simulation results of ion confinement within exemplary ion manipulation devices.
Figure 8B:
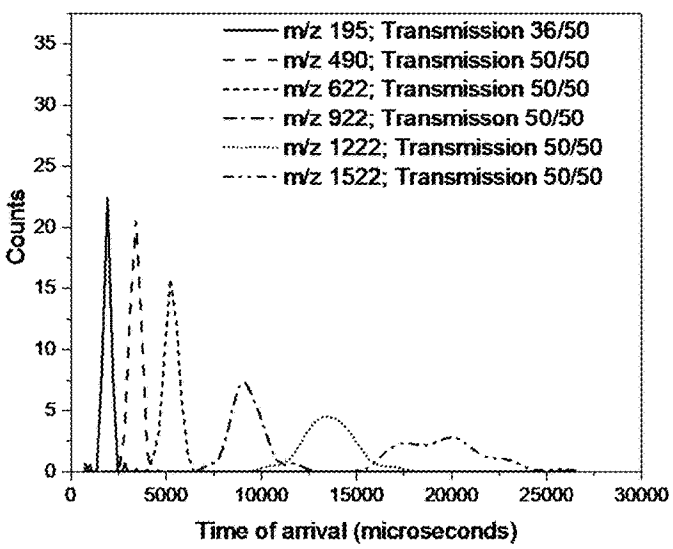
Figure 8C:
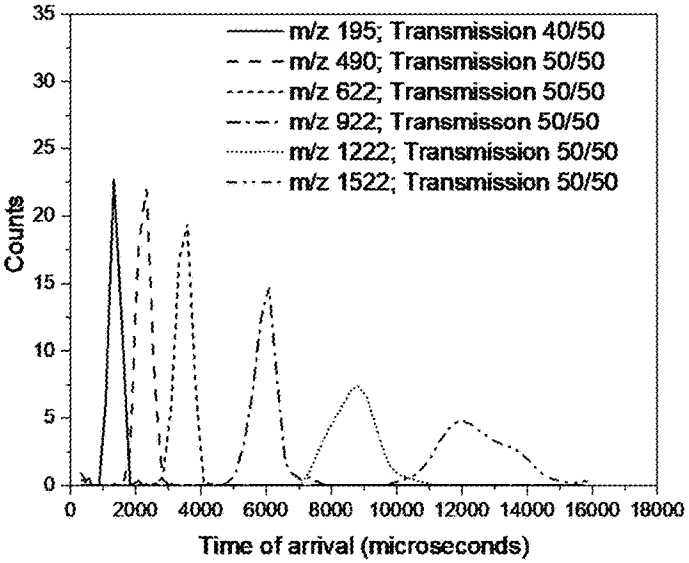
Figure 8D:
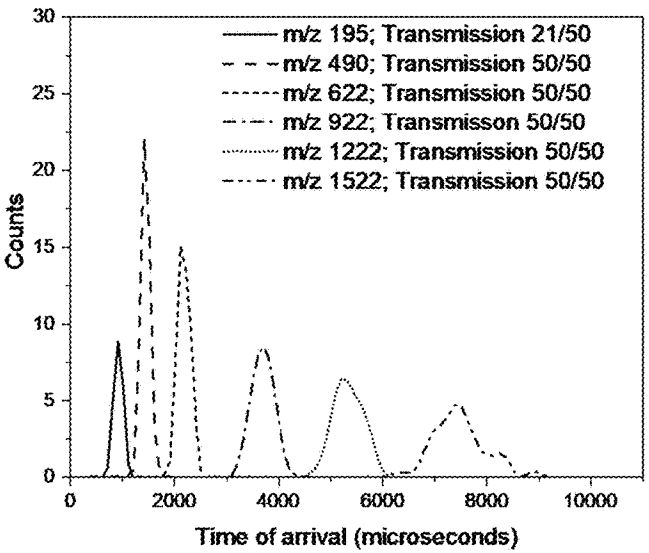

FIGS. 6A-6C show simulation results of three different views of the ion confinement and separation as the ions move forward through device 300. These simulation results were obtained using SIMION® software. As explained above, a voltage source can apply phase shifted frequency modulated AC voltages to each of the electrodes 330 of the surface 315. This can create a traveling pseudopotential that can both confine ions between the surfaces 310, 315 and guide ions between the surfaces through the device 300. In addition, a DC voltage can be applied to the guard electrodes 320, 325. This can create an electric field on the sides of the device 300 to prevent ions from escaping the device from the sides and can keep ions confined towards the center of the device between the surfaces 310, 315.

The simulation of FIG. 6B shows results of applying phase shifted frequency modulated RF voltages to the electrodes and applying a DC voltage to the guard electrodes 320, 325. As can be seen in FIG. 6B, this causes ions to be confined within the device 300 and to move through the device. FIGS. 7A-7D show plots of simulation results for ions traveling through the ion manipulation device 300. Specifically, these figures show plots of ion count vs. time of flight for ions having the following mass/charge ratios (with corresponding reduced mobility values shown in parentheses): 195 (1.54), 490 (1.5), 622 (1.17), 922 (0.97), 1222 (0.85), and 1522 (0.73). This illustrates that the device 300 can be used to separate ions based on their mobility. For the simulations of FIGS. 7A-7D, the length of the electrodes of the electrode array 330 is 0.5 mm, the DC voltage applied to the guard electrodes 320, 325 is 1V, the carrier frequency is 1 MHz, the carrier amplitude is 180V, and the value of 13 is 30. Each of the plots shows simulation results having different modulating signal speeds.

In some examples, the guard electrodes 320, 325 can receive an RF voltage rather than a DC voltage. In these examples, the RF voltage applied to the guard electrodes 320, 325 confines ions to the center of the ion manipulation device and prevents ions from escaping from the sides of the device in a similar manner as when a DC voltage is applied to the guard electrodes. In some examples, the carrier signal described above in connection with FIG. 1B is applied to the guard electrodes 320, 325 without any modulation. FIGS. 8A-8D show plots of simulation results for ions traveling through the device 300 with RF voltages applied to the guard electrodes 320, 325. In the plots shown in FIGS. 8A-8D, the electrode length is 0.5 mm, the carrier frequency of the RF voltage applied to the electrodes of the electrode array 330 is 1.5 MHz, the carrier amplitude is 180V, the value of 13 is 30, and the amplitude of the RF voltage applied to the guard electrodes 320, 325 is 180V with a frequency of 1.5 MHz.

Figure 9:
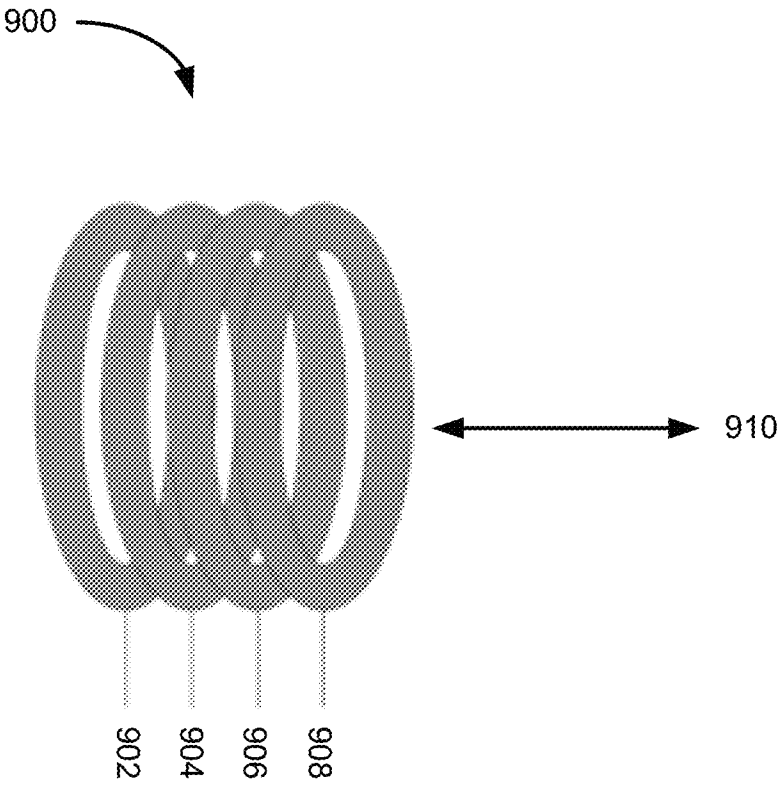
FIG. 9 shows an exemplary embodiment of another ion manipulation device.

FIG. 9 shows another embodiment of an ion manipulation device 900 comprising a plurality of circular ring electrodes 902, 904, 906, 908 defining a central axis 910. In the illustrated example of FIG. 9, the device 900 comprises four ring electrodes. However, in other examples, the device 900 can comprise more than four ring electrodes and the electrodes 902, 904, 906, 908 can comprise different shapes (e.g., rectangular, elliptical). In some examples, the diameter of the rings can vary along the length of the device (e.g., ring 902 can have a smaller diameter than ring 904, which can have a smaller diameter than ring 906, which can have a smaller diameter than ring 908). In some examples, some of the rings can be tilted with respect to adjacent rings such that the device 900 is curved or angled and the opening on one side of the device is not within line of sight of the opening on the other side of the device. This can allow ions to be guided through the device 900 in a path other than straight line. In the example of FIG. 9, a voltage source can apply out-of-phase frequency modulated RF voltages to the ring electrodes 902, 904, 906, 908 in a similar manner as discussed above in connection with FIG. 5A-5D to confine ions within the device 900 and move ions through the device.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

We claim:

1. A method of manipulating ions comprising:

injecting ions between a first surface and a second surface positioned parallel to and spaced apart from each other and defining a central axis therebetween, wherein the first surface comprises first outer electrodes coupled to the first surface and a first inner array of electrodes coupled to the first surface and positioned between the first outer electrodes, and wherein the second surface comprises second outer electrodes coupled to the second surface and a second inner array of electrodes coupled to the second surface and positioned between the second outer electrodes; and applying a frequency modulated RF voltage to at least one electrode of the first inner array of electrodes or the second inner array of electrodes, wherein the frequency modulated RF voltage is configured to confine ions between the first surface and the second surface and to guide ions between the first surface and the second surface along the central axis.

2. The method of claim 1, wherein the frequency modulated RF voltage applied to the at least one electrode of first the inner array of electrodes or the second inner array of electrodes is phase-shifted with a frequency modulated voltage applied to an adjacent electrode.

3. The method of claim 1, wherein the first outer electrodes extend substantially along the length of the first surface and the second outer electrodes extend substantially along the length of the second surface.

4. The method of claim 1, wherein the first inner array of electrodes extends substantially along the length of the first surface and the second inner array of electrodes extends substantially along the length of the second surface.

5. The method of claim 1, wherein the frequency modulated RF voltage comprises a carrier signal and a modulating signal.

6. The method of claim 1, further comprising applying a DC voltage to the first outer electrodes and the second outer electrodes.

7. The method of claim 1, further comprising applying an RF voltage to the first outer electrodes and the second outer electrodes.

8. The method of claim 7, wherein the frequency modulated RF voltage comprises a carrier signal and a modulating signal and wherein the RF voltage applied to the outer electrodes comprises the carrier signal.

9. A method of manipulating ions comprising:

injecting ions within an interior of an apparatus comprising a plurality of ring electrodes arranged longitudinally adjacent to each other and defining a central axis therethrough; and applying a frequency modulated RF voltage to at least one ring electrode to confine ions within the apparatus and to guide ions through the apparatus.

10. The method of claim 9, wherein the frequency modulated RF voltage applied to the at least one ring electrode is phase-shifted with a frequency modulated RF voltage applied to an adjacent ring electrode.

11. The method of claim 1, wherein the frequency modulated RF voltage comprises one of: a sine wave, a triangular wave, a square wave, or a rectangular wave.

12. An ion manipulation device comprising:

a first surface and a second surface positioned parallel to and spaced apart from each other and defining a central axis therebetween;

first outer electrodes coupled to the first surface and second outer electrodes coupled to the second surface;

a first inner array of electrodes coupled to the first surface and a second inner array of electrodes coupled to the second surface; and a voltage source configured to apply a frequency modulated RF voltage to at least one electrode of the first inner array of electrodes or the second inner array of electrodes to confine ions between the first surface and the second surface and to guide ions between the first surface and the second surface along the central axis without a DC voltage being applied to the at least one electrode.

13. The device of claim 12, wherein the frequency modulated RF voltage applied to the at least one electrode is phase-shifted with a frequency modulated RF voltage applied to an adjacent electrode.

14. The device of claim 12, wherein the first inner array of electrodes is positioned between the first outer electrodes; and wherein the second inner array of electrodes is positioned between the second outer electrodes.

15. The device of claim 12, wherein the first outer electrodes extend substantially along the length of the first surface and the second outer electrodes extend substantially along the length of the second surface.

16. The device of claim 12, wherein the first inner array of electrodes extends substantially along the length of the first surface and the second inner array of electrodes extends substantially along the length of the second surface.

17. The device of claim 12, wherein the frequency modulated RF voltage comprises a carrier signal and a modulating signal.

18. The device of claim 12, wherein at least one of the first outer electrodes and the second outer electrodes is configured to receive a DC voltage.

19. The device of claim 12, wherein at least one of the first outer electrodes and the second outer electrodes are configured to receive an RF voltage.

20. The device of claim 17, wherein at least one of the first outer electrodes or the second outer electrodes is configured to receive an RF voltage comprising the carrier signal.

21. The device of claim 12, wherein the first surface and the second surface comprise at least one angled portion.

22. An ion manipulation device comprising:

a plurality of ring electrodes arranged longitudinally adjacent to each other and defining a central axis therethrough; and a voltage source configured to apply a frequency modulated RF voltage to at least one ring electrode to confine ions within an interior of the device and to guide ions through the device along the central axis without a DC voltage being applied to the at least one ring electrode.

23. The device of claim 22, wherein the frequency modulated RF voltage applied to the at least one ring electrode is phase-shifted with a frequency modulated RF voltage applied to an adjacent ring electrode.

24. The device of claim 22, wherein a diameter of at least one ring electrode is different than a diameter of an adjacent electrode.

* * * * *